United States Patent [19]

McCormick

[11] 4,268,254

[45] May 19, 1981

[54] METHOD OF ENHANCING BIMANUAL DEXTERITY

[76] Inventor: Everett N. McCormick, 5049 River Point Rd., Jacksonville, Fla. 32207

[21] Appl. No.: 103,611

[22] Filed: Dec. 14, 1979

[51] Int. Cl.[3] ..... A63B 23/00

[52] U.S. Cl. ..... 434/247

[58] Field of Search ..... 35/29 R, 29 A, 29 B, 35/29 E; 273/29 A, 330; 351/2

[56] References Cited

U.S. PATENT DOCUMENTS

| | | | |
|---|---|---|---|
| 1,130,634 | 3/1915 | Rooney | 351/2 X |
| 3,229,979 | 1/1966 | Smoak | 273/330 |
| 3,814,419 | 6/1974 | Bjorklund | 273/29 A |
| 3,848,467 | 11/1974 | Flavell | 35/29 R UX |

*Primary Examiner*—Harland S. Skogquist

*Attorney, Agent, or Firm*—Arthur G. Yeager

[57] ABSTRACT

A method for enhancing bimanual dexterity of a person having a dominant arm and hand and a nondominant arm and hand which comprises having the person participate in an athletic exercise wherein a bouncing ball is projected toward the person equipped in each hand with an implement for striking the ball and returning it in the direction from which it was projected, the implement employed in the nondominant hand having substantially better physical characteristics for striking the ball than the implement employed in the dominant hand. This is useful in physical therapy for persons handicapped in one arm or otherwise not able to use that arm with normal facility; and it is also useful to provide the normal individual having strength and skill with one arm a method of increasing the strength and skill of the other arm.

7 Claims, 2 Drawing Figures

METHOD OF ENHANCING BIMANUAL DEXTERITY

BACKGROUND OF THE INVENTION

This invention relates to a method for enhancing the dexterity of an arm and hand of a person having less than normal use of that arm and hand due to lack of exercise thereof; whether that lesser use is because of a birth defect an injury, or merely ignoring use of that arm in favor of the skill inherent in the dominant arm.

Most human beings develop early in life a tendency to use one hand and arm more often than the other hand and arm and thus develop a dominant arm and hand which perform most of the tasks for which arms and hands are needed while the nondominant arm remain and hand relatively unused and untrained for many such tasks. In addition there are persons who are born with physical handicaps as well as those who have been injured wherein one arm and hand is used very little and becomes less and less useful. It has been known for some time that suitable physical exercise of the nondominant arm and hand will develop a muscular control and coordination necessary to provide an acceptable dexterity. These procedures have usually involved boring unenjoyable exercises which the person has little incentive to continue on a regular basis. If such an exercise could be incorporated into or made a part of a game or a competitive exercise, with or without opponents, the person is much more likely to take an interest in what he is doing and be motivated to continue the exercise in a regular routine.

It is an object of this invention to provide a specific method involving a procedure which provides the atmosphere of a game or a competitive exercise wherein the person is inclined to employ the nondominant hand more frequently than usual and thereby to develop reliable use and skill of the nondominant hand and arm.

BRIEF SUMMARY OF THE INVENTION

This invention provides a method of enhancing bimanual dexterity of a person having a dominant hand and arm and a nondominant hand and arm which comprises the person participating in an athletic exercise wherein a bouncing ball is projected toward the person equipped in each hand with an implement for striking the ball and returning it in the direction from which it was projected, the implement employed in the nondominant hand having substantially better physical characteristics for striking the ball than the implement employed in the dominant hand. In the specific embodiments of this invention each implement is a strung racquet wherein the striking area of the racquet for the nondominant hand is 15–30% larger than that for the dominant hand. In other embodiments of this invention the racquet for the nondominant hand has a smaller handle and/or less string tension than that for the dominant hand.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
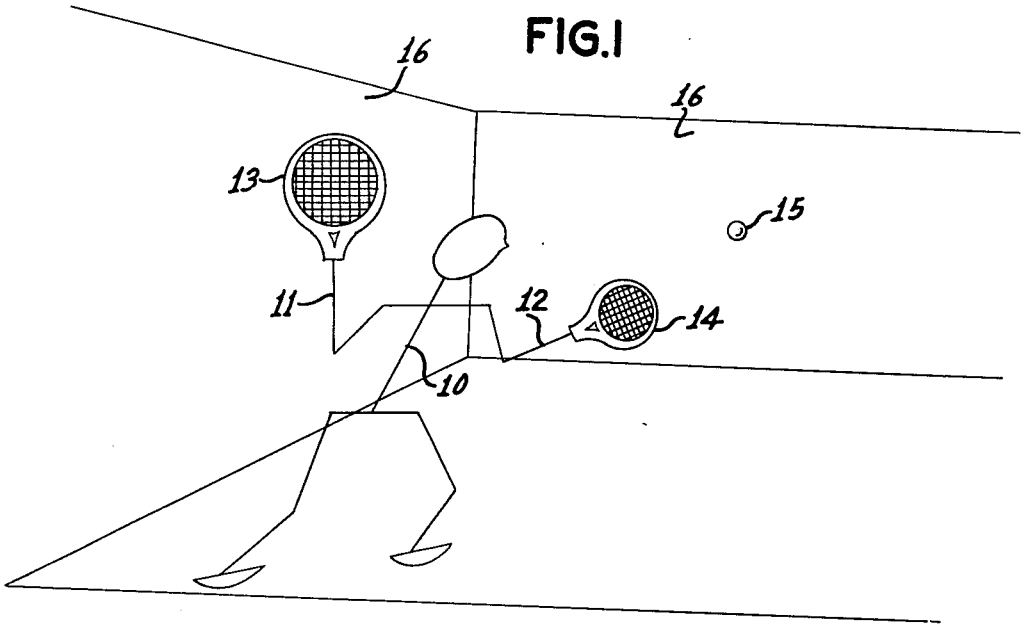
FIG. 1 is a pictorial illustration of the method of this invention which a person employs different size racquet in each hand for hitting a bouncing ball against one or more walls.

In FIG. 1 there is shown a person 10 engaged in hitting a bouncing ball 15 against a solid wall 16 such as the practice wall of a tennis court or the playing walls in the game of racquetball, squash, or the like. The player 10 has a nondominant arm 11 and a dominant arm 12. In each hand he holds a racquet for hitting ball 15. Racquet 13 for nondominant arm 11 contains a larger striking area than does racquet 14 for dominant arm 12. There may be other features and characteristics of racquet 13 which make it substantially better for striking ball 15. Such characteristics may incllude a shorter grip length for racquet 13 than for racquet 14, and it may also include less tension in the strings of racquet 13 than that of racquet 14, in order to provide an enlarged area for properly striking the ball for a return shot.

Figure 2:
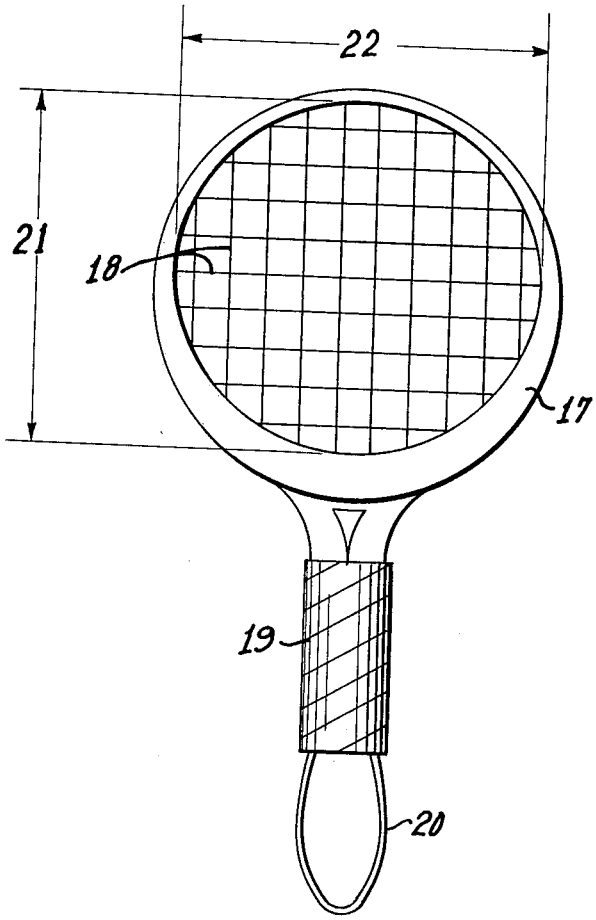
FIG. 2 is an illustration of a racquet which may be employed in the method of this invention.

In FIG. 2 there is shown a racquet typically employed in the game of racquetball. The racquet has a frame 17, strings 18, a grip 19, and a safety wrist loop 20. Frame 17 may be wood, plastic, or metal such as aluminum. Strings 18 are typically gut or nylon.

For the purposes of this invention a racquet as shown in FIG. 2 is employed in each hand of the player but the racquet employed in the nondominant hand is designed to have substantially better physical characteristics for striking the ball than the racquet held in the dominant hand. The player is aware of the fact that he should use the nondominant arm as much as possible and will be encouraged to do so by employing a racquet which will compensate for the reduced power, coordination, and accuracy of the nondominant hand. Furthermore, this invention can be incorporated into a game where the rules of play require striking the ball alternately with the nondominant arm and the dominant arm, and thereby provide motivation to use the nondominant arm. The better physical characteristics which will assist the nondominant hand in properly striking the ball include a larger striking area, a shorter grip length, less string tension, and an equal or smaller racquet weight. The following tabulation indicates the comparative characteristics for racquets such as shown in FIG. 2 which might typically be employed by adults or by children following the method of this invention.

| | RACQUET CHARACTERISTICS | | | | | | | | |
|---|---|---|---|---|---|---|---|---|---|
| | Overall Length cm. | Grip Length cm. | Striking Surface Length* cm. | Striking Surface Width** cm. | Striking Surface Area Sq. cm. | Number Strings Longi-tudinal | Number Strings Hori-zontal | Racquet Weight gm. | String Tension lbs. |
| Adult Dominant Hand | 41 | 14 | 21 | 18 | 290–310 | 16 | 18 | 245–280 | 25–30 |
| Adult Nondominant Hand | 41 | 12 | 23 | 20 | 340–360 | 16 | 18 | 245–280 | 20–25 |
| Child Dominant Hand | 31 | 10 | 18 | 16 | 225–245 | 14 | 16 | 225–240 | 25–30 |
| Child Nondominant Hand | 31 | 8 | 20 | 18 | 275–295 | 14 | 16 | 225–240 | 20–25 |

*See reference 21 in FIG. 2
**See reference 22 in FIG. 2

It is, of course, to be understood that other designs of racquets may be employed within the spirit of this invention. For example, if the player has a particular interest in tennis rather than racquetball the racquets employed may be of the design used in the game of tennis rather than the short handled racquet shown in FIG. 2. Similarly, squash racquets might be employed. The operation of this method need not be limited to a single player hitting a bouncing ball against a solid wall which bounces off that wall and returns to the player. There may be two or more players involved in this method wherein the second player throws or hits the ball to the player employing two racquets as set forth in this invention. This might, for example, be accomplished on a regular tennis court hitting balls over the net in the normal fashion. It might also take place with ping pong (table tennis) equipment on a table wherein the racquet is a paddle rather than a strung racquet. The game of badminton may also be employed for purposes of this invention by having suitably designed racquets for each hand in accordance with this invention. The principal feature involved in practicing this invention is to provide opportunity for striking a ball with an implement in the nondominant hand which is larger in striking area and yet requires less force to hit the ball than the implement employed in the dominant hand.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. Method of enhancing bimanual dexterity of a person having a dominant hand and arm and a nondominant hand and arm which comprises the person participating in an athletic exercise wherein a bouncing ball is projected toward the person equipped in each hand with an implement for striking the ball and returning it in the direction from which it was projected, the implement employed in the nondominant hand having substantially better physical characteristics for striking the ball than the implement employed in the dominant hand.

2. The method of claim 1 wherein said implement is a strung racquet.

3. The method of claim 2 wherein the racquet for the nondominant hand is 15–30% larger in striking area than the racquet for the dominant hand.

4. The method of claim 2 wherein the grip length of the racquet for the nondominant hand is 15–30% shorter than that of the racquet for the dominant hand.

5. The method of claim 2 wherein the string tension in the racquet for the nondominant hand is 15–30% smaller than that for the dominant hand.

6. Method of claim 1 wherein said implement is a solid paddle.

7. Method of claim 6 wherein the striking area of the paddle is 15–30% larger for the nondominant hand than for the dominant hand.

* * * * *